US007004155B2

(12) United States Patent
Murata et al.

(10) Patent No.: US 7,004,155 B2
(45) Date of Patent: Feb. 28, 2006

(54) IGNITION APPARATUS FOR INTERNAL COMBUSTION ENGINE

(75) Inventors: Shigemi Murata, Tokyo (JP); Takeshi Shimizu, Tokyo (JP); Mitsuru Koiwa, Tokyo (JP)

(73) Assignee: Mitusbishi Denki Kabushiki Kaisha, Tokyo (JP)

( * ) Notice: Subject to any disclaimer, the term of this patent is extended or adjusted under 35 U.S.C. 154(b) by 147 days.

(21) Appl. No.: 10/262,860

(22) Filed: Oct. 3, 2002

(65) Prior Publication Data

US 2003/0217741 A1 Nov. 27, 2003

(30) Foreign Application Priority Data

May 24, 2002 (JP) ..... 2002-150284

(51) Int. Cl.
*F02P 3/02* (2006.01)
*H01F 27/02* (2006.01)

(52) U.S. Cl. ..... 123/634; 336/96

(58) Field of Classification Search ..... 123/634, 123/635, 643; 336/96
See application file for complete search history.

(56) References Cited

U.S. PATENT DOCUMENTS 4,658,799 A * 4/1987 Kusaka et al. ..... 123/634
5,416,459 A * 5/1995 Ida et al. ..... 336/96
5,438,971 A * 8/1995 Murata et al. ..... 123/634
5,585,773 A * 12/1996 Murata et al. ..... 336/96
5,669,367 A * 9/1997 Sawazaki et al. ..... 123/635
6,107,790 A * 8/2000 Sawazaki et al. ..... 123/634
6,575,151 B1 * 6/2003 Murata et al. ..... 336/96

FOREIGN PATENT DOCUMENTS

| | | | |
|---|---|---|---|
| JP | 50-14039 | A | 4/1975 |
| JP | 63-293908 | A | 11/1988 |
| JP | 7-29751 | A | 1/1995 |
| JP | 7-127554 | A | 5/1995 |
| JP | 8-5540 | | 2/1996 |
| JP | 8-97059 | A | 4/1996 |
| JP | 8-319932 | A | 12/1996 |
| JP | 10-22144 | A | 1/1998 |
| JP | 2001-355557 | A | 12/2001 |
| JP | 2002-110433 | A | 4/2002 |

* cited by examiner

*Primary Examiner*—Tony M. Argenbright
(74) *Attorney, Agent, or Firm*—Sughrue Mion, PLLC

(57) ABSTRACT

An ignition apparatus for an internal combustion engine can be reduced in size and cost. A plurality of closed magnetic circuit cores (2) are built in a casing (8) and each have an excitation portion (2*a*) and non-excitation portions (2*b*). A plurality of coil parts (100) each includes a primary coil (4) and a secondary coil (6) which are arranged to surround the excitation parts (2*a*) of a corresponding one of the closed magnetic cores (2). The closed magnetic circuit cores (2) are arranged along an axial direction (A) of the coil parts (100) such that adjacent ones of the non-excitation portions (2*b*), which are those sides of adjacent cores (2) each of which extends from one end of a corresponding excitation portion (2*a*), overlap each other at least partially in the axial direction (A).

30 Claims, 10 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine which has a plurality of transformers arranged in a casing, and which supplies a high voltage to a spark plug for each engine cylinder.

2. Description of the Related Art

FIG. 11 is a cross sectional side view of an ignition apparatus 1 for an internal combustion engine shown in Japanese Utility Model Publication No. Hei 8-5540. FIG. 12 is a cross sectional view taken along line XII—XII of FIG. 11.

The ignition apparatus 1 illustrated is used by a simultaneous ignition system for an internal combustion engine, and includes three transformers each having a secondary transformer connected at its opposite ends to two spark plugs for use with an internal combustion engine having six cylinders.

The first through third transformers 1A, 1B and 1C of the ignition apparatus 1 for an internal combustion engine are accommodated in a casing 8 made of a resin with high-voltage towers 8*a* being arranged at its head. Each of the first through third transformers 1A, 1B and 1C includes a coil part 100 which is provided with a closed magnetic circuit core 2 forming a hollow-rectangular-shaped closed magnetic circuit, a primary coil 4 with a conducting wire being wound around a primary bobbin 3 surrounding an excitation portion 2*a* of the closed magnetic circuit core 2, and a secondary coil 6 with a conducting wire being wound around a secondary bobbin 5 surrounding the primary coil 4. Each coil part 100 is fixedly secured to an inner side of the casing 8 by a casted resin portion 12 of a thermosetting property such as an epoxy resin or the like.

The respective closed magnetic circuit cores 2 of the transformers 1A, 1B and 1C have their central axes arranged in the same direction, and the excitation portion 2*a*, the primary coil 4 and the secondary coil 6 for each core 2 are arranged on a side opposite an opening of the casing 8. Each closed magnetic circuit core 2 has another side portion 2*f* opposing the corresponding excitation portion 2*a* located at the opening side of the casing 8. The conducting wire of each primary coil 4 is electrically connected at its one end with an unillustrated external connection terminal through a conductor 10 arranged inside the ignition apparatus and a connector terminal 10*a* in a connector 9*a*, and it is finally connected through the external connection terminal to a power supply (not shown) such as a battery of a vehicle. The conducting wire of each primary coil 4 is finally connected at its other end with a corresponding terminal of a switching module (not shown), e.g., a collector of a corresponding one of power transistors which constitute the switching module.

The conducting wire of each secondary coil 6 is connected at its opposite ends with terminals 6*a*, respectively, fixedly attached to a fixed part 5*a* of the secondary bobbin 5 by means of soldering or the like. The terminals 6*a* are electrically connected with corresponding secondary terminals or high-voltage terminals 8*b* which are assembled to the casing 8 through insert molding or press fitting. The casing 8 has high-voltage towers 8*a* protruded from portions thereof in which the coil parts 100 are received in the casing 8. Connected with each secondary terminal 8*b* is one end of a high-tension cord (not shown) which is in turn connected at its other end with a spark plug (not shown).

With the ignition apparatus 1 for an internal combustion engine as referred to above, after the plurality of transformers 1A, 1B, 1C, the conductors 10, etc., are arranged at their prescribed positions in the casing 8, a resin such as an epoxy resin is injected into the casing 8 of a bottomed cylindrical configuration under a vacuum atmosphere and then set or cured at a high temperature in a curing oven, thus achieving the fixed mounting of the built-in components within the casing 8 and the insulation thereof against high voltages.

Now, the operation of the ignition apparatus 1 for an internal combustion engine as constructed above will be explained below.

When coil drivers (not shown) such as power transistors are driven by a control signal from a control unit (not shown) of the internal combustion engine, a primary current flowing through the primary coils 4 is controlled to be supplied and interrupted in an appropriate manner by the coil drivers. That is, the coil drivers are turned off at prescribed ignition timing of the internal combustion engine thereby to cut off the primary current of the corresponding primary coils 4, whereupon counterelectromotive forces are generated in the primary coils 4 whereby high voltages are produced in the secondary coils 6 of the transformers 1A, 1B and 1C. As a result, the high voltages thus produced are impressed on the spark plugs (not shown) connected with the secondary coils 6, whereby air fuel mixtures in the unillustrated engine cylinders are dielectrically broken down, as a consequence of which electrical discharges are caused due to a secondary current flowing through the secondary coils 6, thus firing the air fuel mixtures in the engine cylinders.

The known ignition apparatus 1 for an internal combustion engine as constructed above involves the following problems. That is, as can be seen from FIG. 11, the respective transformers 1A, 1B and 1C are arranged in such a manner that the respective planes of the hollow-rectangular-shaped closed magnetic circuit cores 2 (i.e., planes normal to the surface of the sheet of FIG. 11) in the casing 8 are disposed in a parallel relation with respect to one another. As a result, the overall height of the casing 8 becomes high. In addition, the high-voltage towers 8*a* of the casing 8 protrude from those portions of the casing 8 in which the coil parts 100 are received, and hence the overall height of the total casing 8 including the secondary terminals 8*b* and the high-tension cords connected therewith becomes large. This results in a great disadvantage to the arrangement of the ignition apparatus inside the engine room of a limited space in the vehicle.

Moreover, there are additional various problems, too, as described below. That is, because the overall height of the casing 8 becomes large, the amount of material for the casted resin portion 12 filling an accordingly increased extra space in the casing 8 is increased, thus increasing the cost of manufacture accordingly.

When the high-tension cords 13 are attached to the ignition apparatus 1 in a state of its having been assembled to the internal combustion engine 14, as shown in FIG. 13, the high-voltage towers 8*a* are disposed in mutually closely adjacent locations with practically no room in space therearound. Thus, the efficiency in the assembling operation of the high-tension cords 13 is poor.

Further, it is necessary to secure a special space for exclusive use with a plurality of conductors electrically connecting the primary coils 4 and the secondary coils 6 with the external connection terminals, thus resulting in an increased size of the entire ignition apparatus.

Furthermore, in cases where the switching module for switching on and off the current supplied to the primary coils 4 is incorporated in the ignition apparatus 1 or the casing 8 in order to achieve reduction in the total cost of the ignition apparatus, it is necessary to secure a special space for this purpose, thus resulting in an increased size of the entire apparatus.

Besides, although the transformers 1A, 1B and 1C in the casing 8 are fixed thereto by means of the casted resin portion 12, reliability of the apparatus is impaired due to cracks generated especially in the casted resin portion 12 at the opening of the casing 8 by thermal strain caused by a difference in the coefficients of linear expansion of the respective members resulting from a variation in the heat of the primary coils 4 and a change in the temperature of the surrounding environment.

SUMMARY OF THE INVENTION

The present invention is intended to solve the problems as referred to above, and has for its object to provide an ignition apparatus for an internal combustion engine which can be reduced in size and cost.

Another object of the present invention is to provide an ignition apparatus for an internal combustion engine in which the generation of cracks in a casted resin portion can be reduced.

Bearing the above objects in mind, according to one aspect of the present invention, the present invention resides in an ignition apparatus for an internal combustion engine which includes: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The plurality of closed magnetic circuit cores are arranged along an axial direction of the coil parts in such a manner that adjacent ones of the non-excitation portions, which are those sides of adjacent cores each of which extends from one end of a corresponding excitation portion, overlap each other at least partially in the axial direction of the coil parts. With this arrangement, the size of the casing in the axial direction of the coil parts is shortened, and hence the entire size and manufacturing cost of the ignition apparatus is reduced.

According to another aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The plurality of closed magnetic circuit cores are arranged along an axial direction of the coil parts in such a manner that the planes of the closed magnetic circuit cores are disposed flush with one another and in parallel with a bottom surface of the casing. With this arrangement, by shortening the total height of the casing, the size and the manufacturing cost of the ignition apparatus is reduced.

According to a further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The plurality of closed magnetic circuit cores are arranged along an axial direction of the coil parts, and the plurality of coil parts are arranged on those sides of the cores which are at mutually different sides in a zigzag form along the axial direction of the coil parts. With this arrangement, when high-tension codes are attached to the ignition apparatus which has been mounted on the internal combustion engine, there is ample room in space in the surroundings of the high-voltage towers, so that the efficiency in the assembling operation of the high-tension cords can be improved.

According to a yet further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a plurality of conductors electrically connecting between the coil parts and external connection terminals. The plurality of closed magnetic circuit cores are arranged along an axial direction of the coil parts in such a manner that the planes of the closed magnetic circuit cores are disposed flush with one another to form one and the same plane and in parallel with a bottom surface of the casing. The plurality of conductors combined with one another are arranged in parallel with the one and the same plane in an area in which the conductors are not superposed on the coil parts. With this arrangement, an empty space over the coil parts can be utilized for the arrangement of the conductors, and hence effective use of the space within the casing can be made. As a result, the size and manufacturing cost of the ignition apparatus can be reduced.

According to a still further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and an electronic part for controlling operations of the coil parts. The plurality of closed magnetic circuit cores are arranged along an axial direction of the coil parts in such a manner that the planes of the closed magnetic circuit cores are disposed flush with one another to form one and the same plane and in parallel with a bottom surface of the casing. The electronic part is arranged in parallel with the one and the same plane in an area in which the electronic part is not superposed on the coil parts. With this arrangement, no new or additional space for the arrangement of the electronic part is necessary, and hence there is no need to increase the size of the ignition apparatus.

According to a further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; an electronic part for controlling operations of the coil parts; and secondary terminals connected with the secondary coils. The plurality of closed magnetic circuit cores are arranged along an axial direction of the coil parts in such a manner that the planes of the closed magnetic circuit cores are disposed flush with one another to form one and same plane and in parallel with a bottom surface of the casing. The electronic part is arranged in parallel with the one and same plane and on axes of the secondary terminals. With this arrangement, the electronic part can be arranged in a space where high-voltage towers are installed. Consequently, no new or additional space for the arrangement of the electronic part is necessary, and hence there is no need to increase the size of the ignition apparatus.

According to a further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The casing is provided with mounting portions fixedly secured to the internal combustion engine. With this arrangement, the mounting portions are arranged on separate members which are formed separately from and arranged in the casing. Accordingly, a change in the design of the mounting portions can be dealt with by merely changing the design of the casing including the mounting portions alone. As a result, the degree of freedom in design can be improved.

According to a further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a resin portion filled in the casing to fixedly secure the closed magnetic circuit cores and the coil parts to the casing. Buffer members are provided on the sides of the closed magnetic circuit cores except for the excitation portion so as to surround these sides thereby to buffer thermal stress generated in the resin portion. With this arrangement, stress due to thermal strain caused by a difference in the coefficients of linear expansion of the closed magnetic circuit cores and the resin portion under a thermal shock atmosphere can be absorbed by the buffer members. Consequently, it is possible to prevent the generation of cracks in the resin portion more efficiently.

According to a further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a resin portion filled in the casing to fixedly secure the closed magnetic circuit cores and the coil parts to the casing. The casing is formed at its opening side with a concave portion having an air layer for absorbing thermal deformations of the resin portion. With this arrangement, stress due to thermal strain caused by a difference in the coefficients of linear expansion of the component members in the casing and the resin portion at an opening of the casing under a thermal shock atmosphere can be absorbed by the air layer in the concave portion. Accordingly, it is possible to prevent the generation of cracks in the resin portion more efficiently.

According to a further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; a resin portion filled in the casing to fixedly secure the closed magnetic circuit cores and the coil parts to the casing; and a conductor module having a plurality of insert-molded conductors for electrically connecting between the coil parts and external connection terminals. The conductor module is formed with a concave portion having an air layer for absorbing thermal deformations of the resin portion. With this arrangement, stress due to thermal strain caused by a difference in the coefficients of linear expansion of the component members in the casing and the resin portion at an opening of the casing under a thermal shock atmosphere can be absorbed by the air layer in the concave portion. This serves to prevent the generation of cracks in the resin portion. In addition, the conductor module that bundles the plurality of conductors also has the function of air layers and contributes to reduction in the cost of manufacture.

According to a further aspect of the present invention, there is provided an ignition apparatus for an internal combustion engine which includes: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a resin portion filled in the casing to fixedly secure the closed magnetic circuit cores and the coil parts to the casing. The casing is provided on its outer periphery with a small container having an air layer for absorbing thermal deformations of the resin portion. With this arrangement, stress due to thermal strain caused by a difference in the coefficients of linear expansion of the component members in the casing and the resin portion at an opening of the casing under a thermal shock atmosphere can also be absorbed by the small container. This serves to prevent the generation of cracks in the resin portion.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinafter, preferred embodiments of the present invention will be described in detail while referring to the accompanying drawings. The same or corresponding parts of the following preferred embodiments of the present invention as those in the known ignition apparatus described above will be identified by the same symbols.

Embodiment 1.

Figure 1:
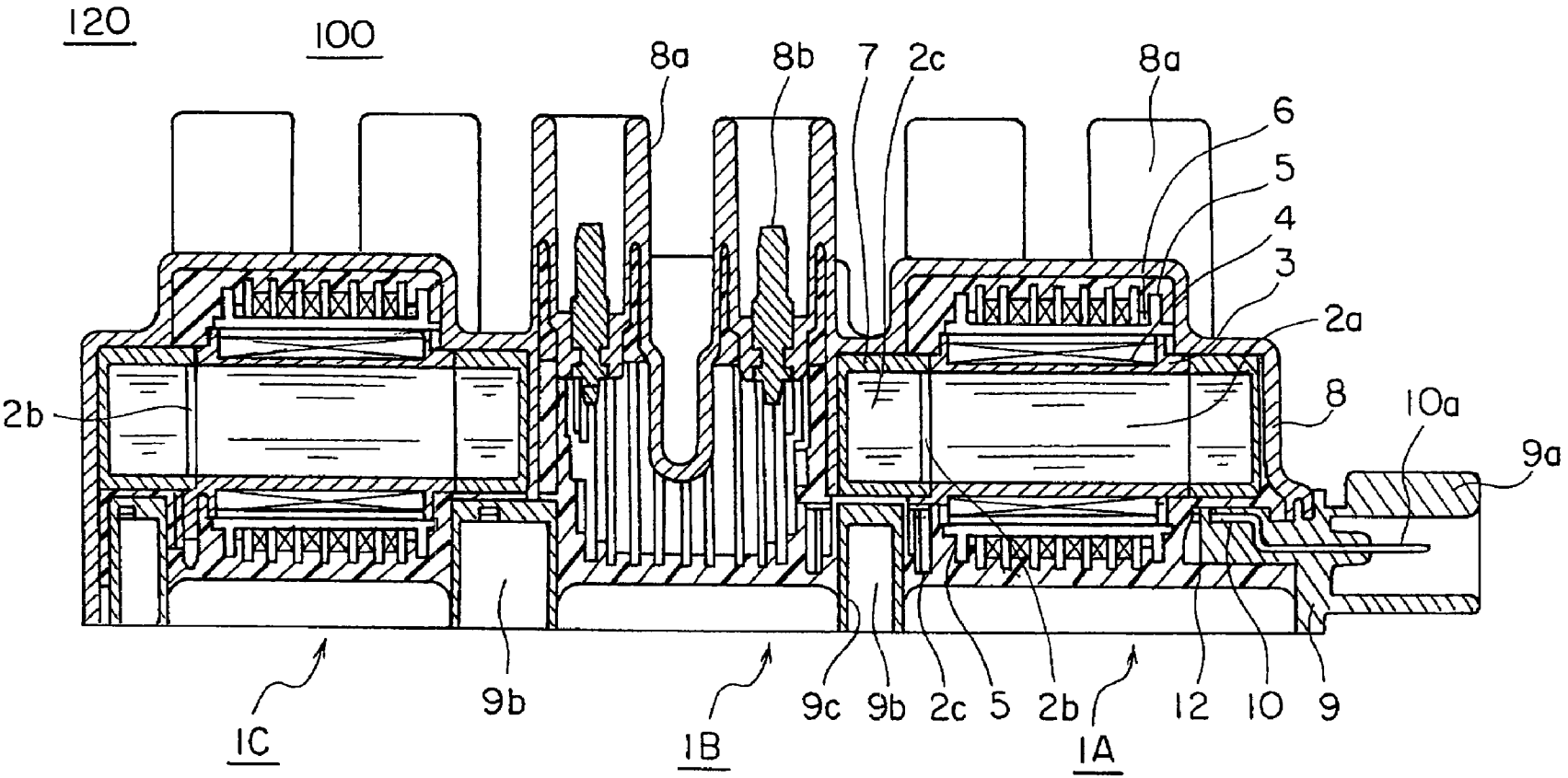
FIG. 1 is a cross sectional view showing an ignition apparatus for an internal combustion engine according to a first embodiment of the present invention.
Figure 2:
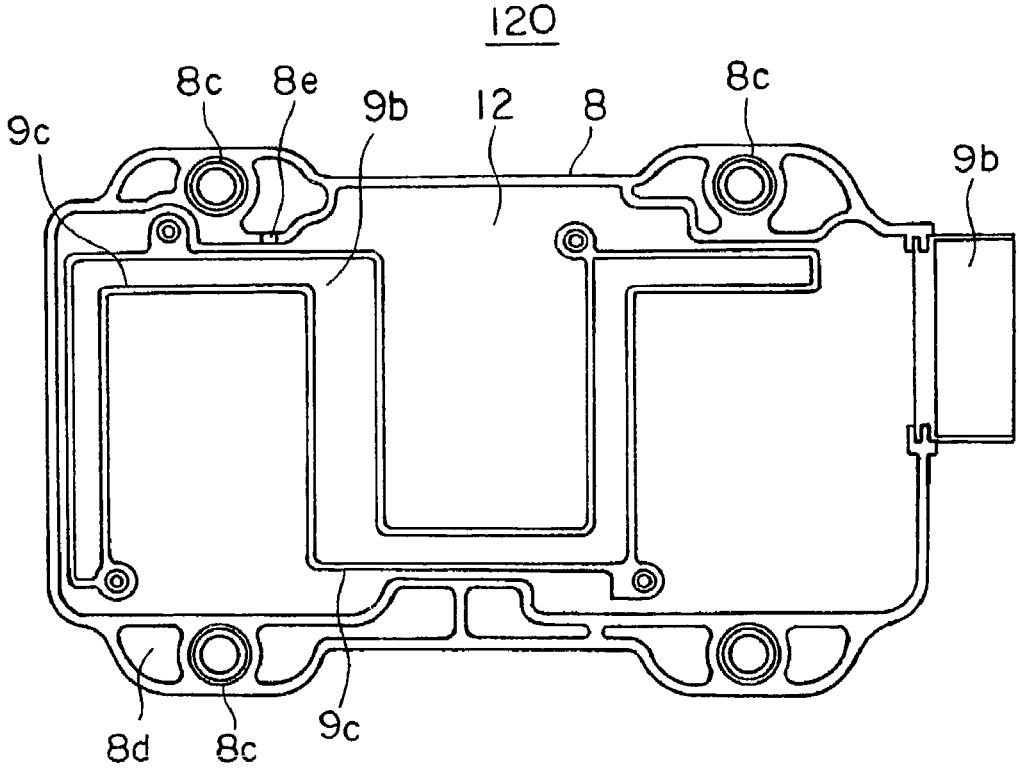
FIG. 2 is a view of the ignition apparatus for an internal combustion engine of FIG. 1 when it is seen from an opening side of a casing.
Figure 3:
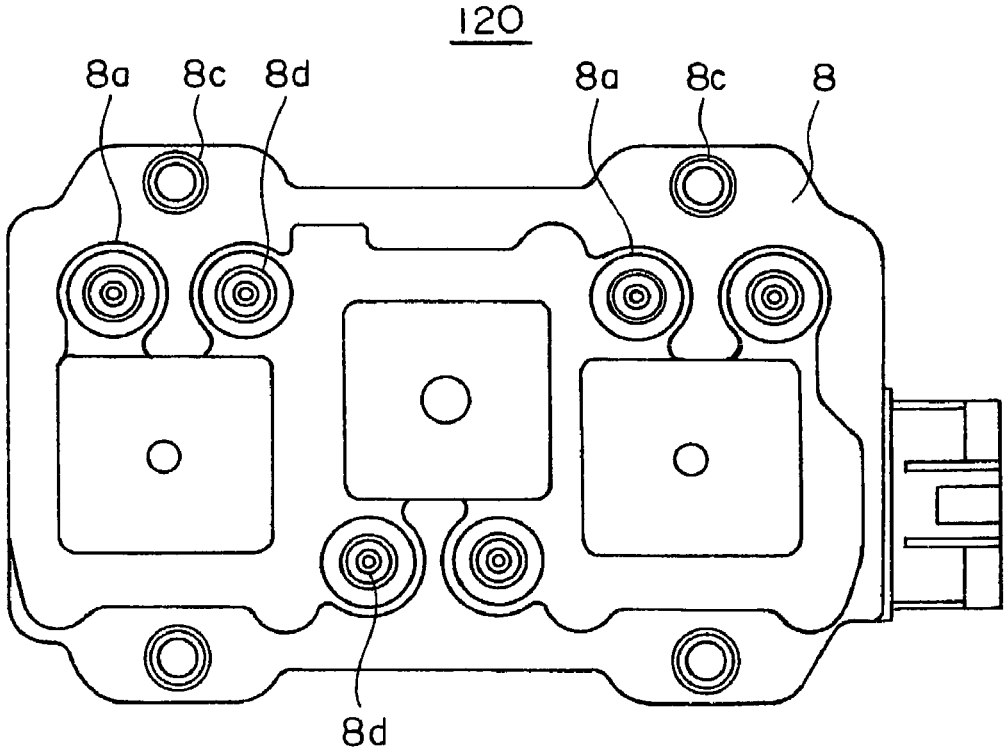
FIG. 3 is a rear view of FIG. 2.
Figure 4:
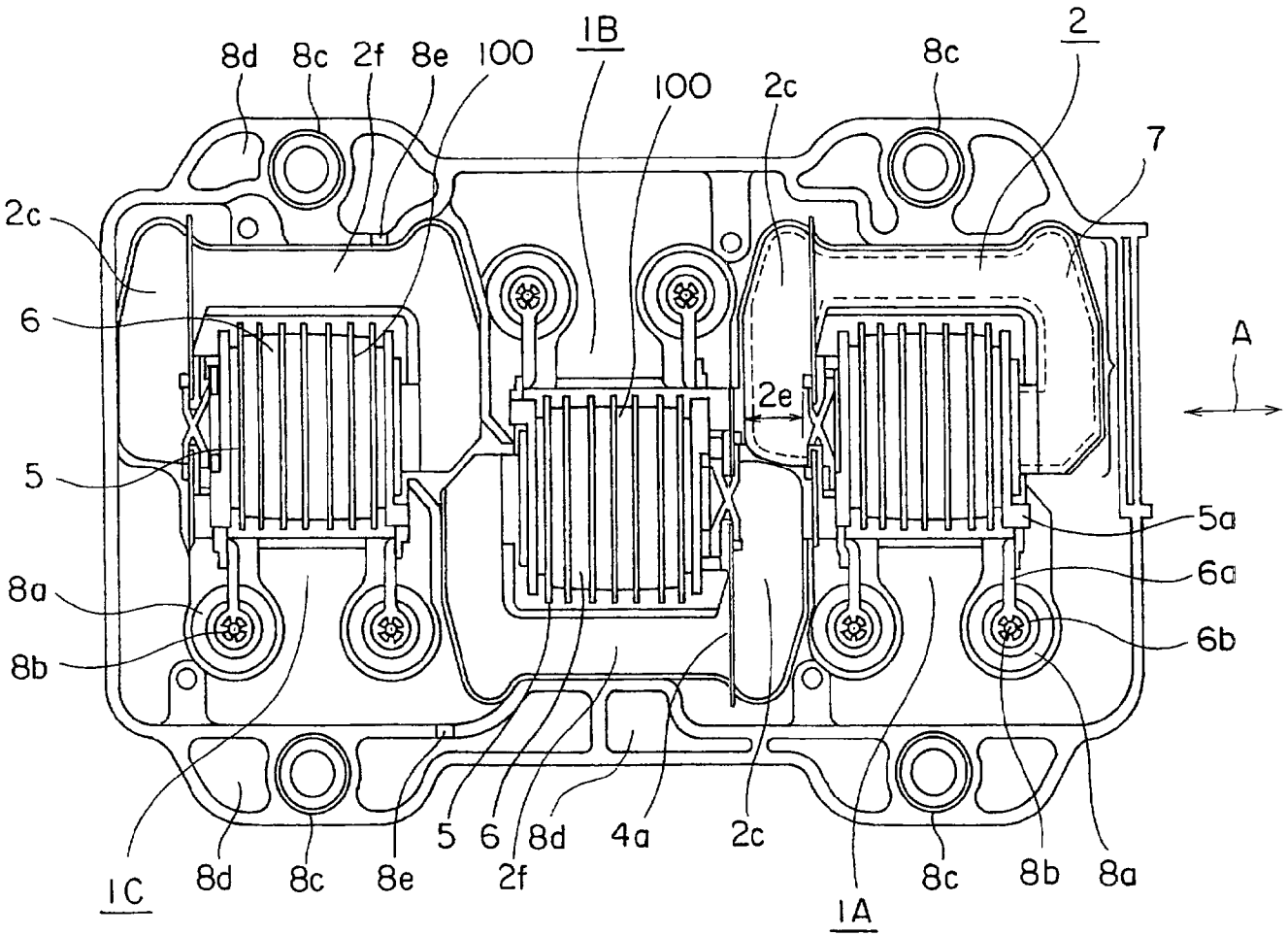
FIG. 4 is a view of the ignition apparatus for an internal combustion engine of FIG. 2 with a casted resin portion and a conductor module being excluded.
Figure 5:
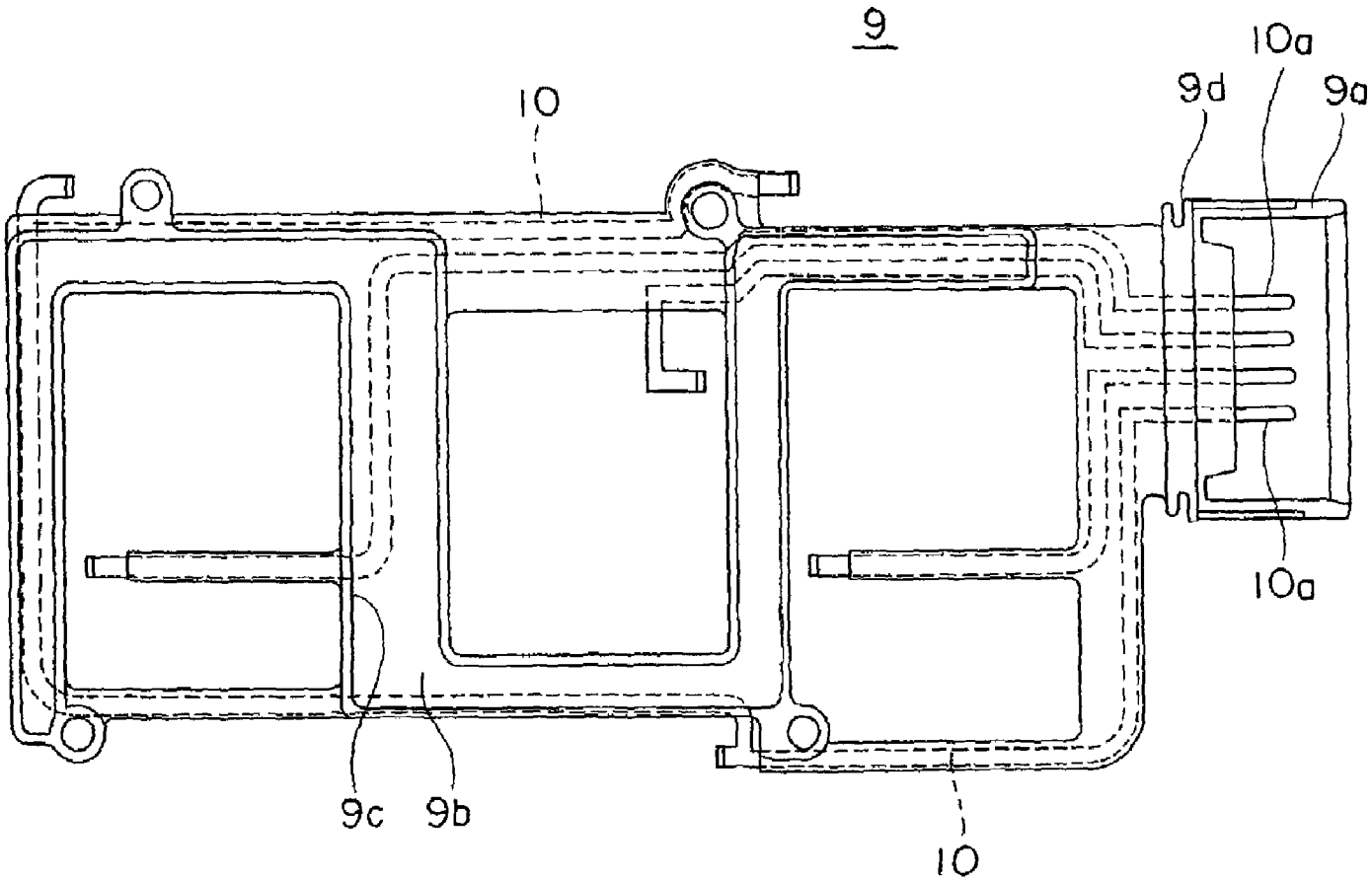
FIG. 5 is a plan view of the conductor module of FIG. 1.
Figure 6:
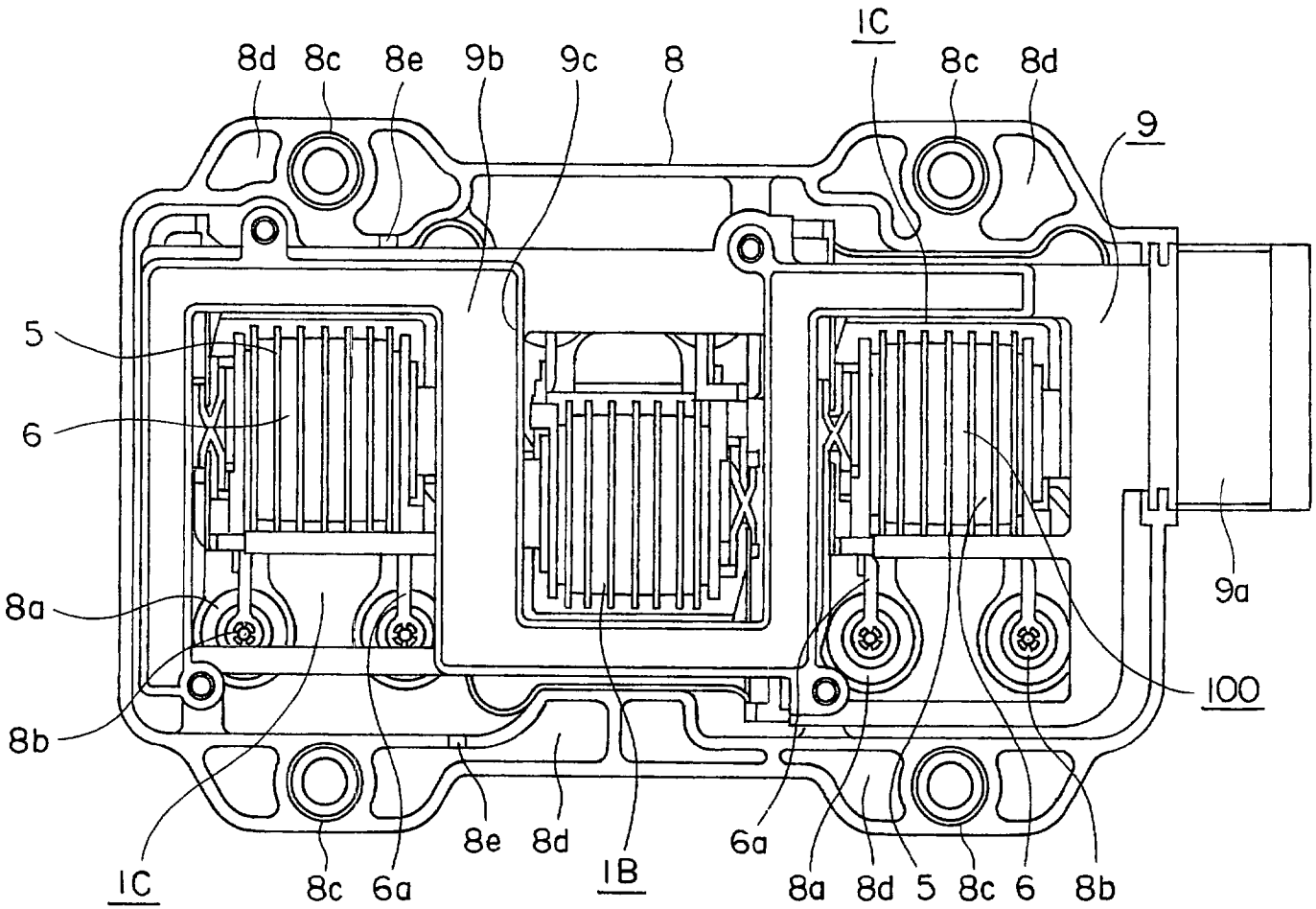
FIG. 6 is a view of the ignition apparatus for an internal combustion engine of FIG. 4 when the conductor module is mounted thereon.

FIG. 1 is a cross sectional view which shows an ignition apparatus for an internal combustion engine according to a first embodiment of the present invention. FIG. 2 is a view of the ignition apparatus for an internal combustion engine of FIG. 1 when it is seen from an opening side of a casing. FIG. 3 is a rear view of FIG. 2. FIG. 4 is a view of the ignition apparatus for an internal combustion engine of FIG. 2 with a casted resin portion 12 and a conductor module 9 being excluded. FIG. 5 is a plan view of the conductor module 9 of FIG. 1. FIG. 6 is a view of the ignition apparatus for an internal combustion engine of FIG. 4 when the conductor module 9 is mounted on the ignition apparatus.

An ignition system 120 for an internal combustion engine illustrated is used by a simultaneous ignition system, and includes three transformers each having a secondary transformer connected at its opposite ends to two spark plugs for use with a six-cylinder internal combustion engine.

The first through third transformers 1A, 1B and 1C of the ignition apparatus 120 for an internal combustion engine are received in a casing 8 which is molded with a resin and has high-voltage towers 8*a* formed at its head. The first through third transformers 1A, 1B and 1C are each provided with a closed magnetic circuit core 2 having a coil part 100 and a gap 2*b*. Each coil part 100 includes a primary coil 4 with a conducting wire wound around a primary bobbin 3 surrounding an excitation portion 2*a* of a corresponding closed magnetic circuit core 2, and a secondary coil 6 with a conducting wire wound around a secondary bobbin 5 surrounding the primary coil 4. Each closed magnetic circuit core 2 of a hollow rectangular shape is composed of a plurality of thin plate members in the form of electromagnetic steel plates laminated one over another. A non-excitation portion 2*c* of each closed magnetic circuit core 2 is overcoated with a buffer member 7 made of an elastic material such as a resin, rubber, a thermoplastic elastomer, etc. The hardness of the buffer member 7 is set to a shore hardness between A64 and A87.

Each coil part 100 is fixedly supported by a casted resin portion 12 of a thermosetting property made of a thermosetting material such as an epoxy resin or the like in the casing 8.

The conducting wire of each primary coil 4 is electrically connected at it one end with a conductor 10 arranged in the ignition apparatus, a corresponding connector terminal 10*a* in a connector 9*a*, and external equipment, and it is finally connected with a power supply (not shown) such as a battery of a vehicle for the primary coils 4. Also, the conducting wire of each primary coil 4 is connected at its other end with a corresponding terminal of a switching module (not shown), e.g., a collector of a corresponding one of power transistors which constitute the switching module.

Figure 7:
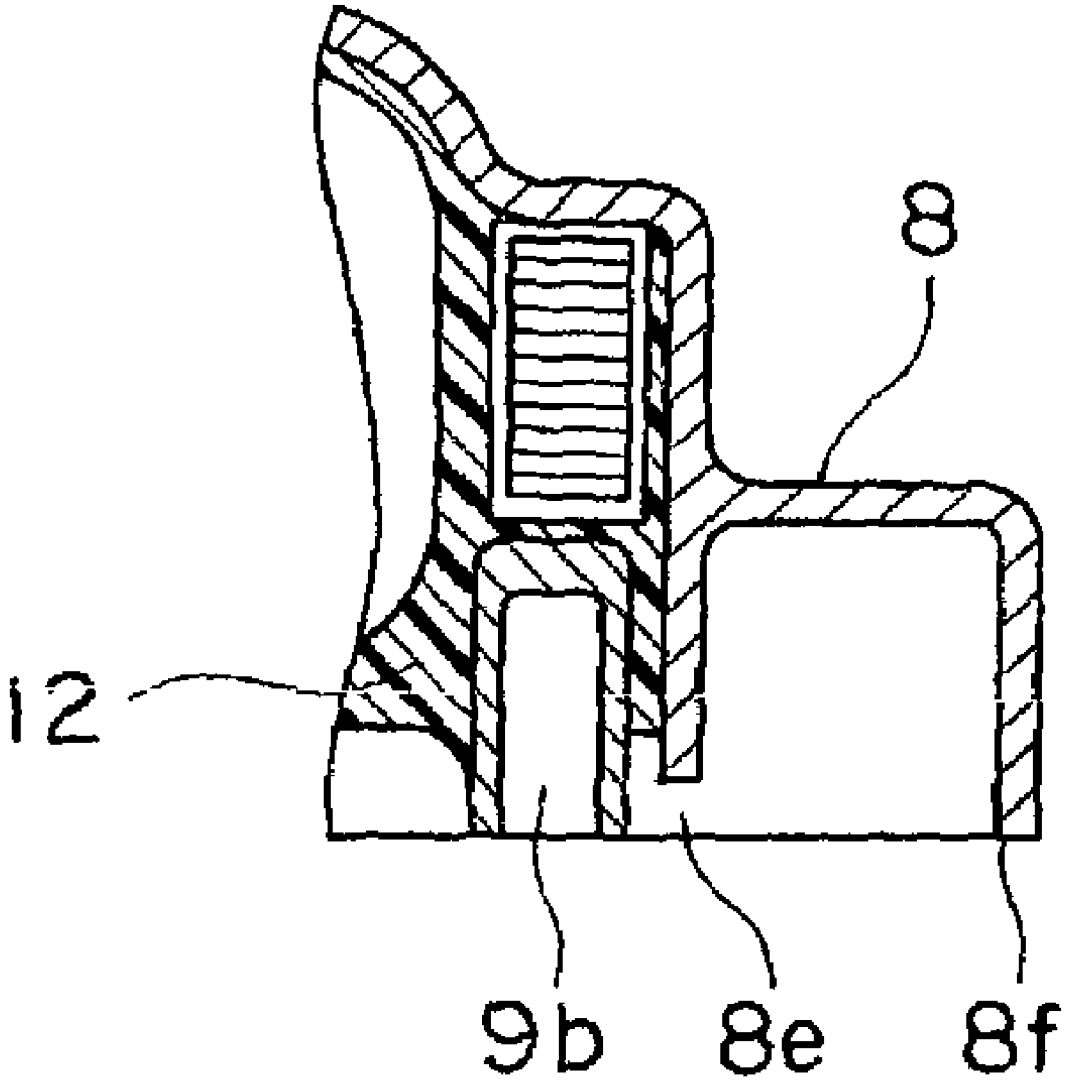
FIG. 7 is a cross sectional view of essential portions of the ignition apparatus for an internal combustion engine of FIG. 6.

The casing 8 has small containers or voids 8*d* formed at the opposite sides of each mounting portion 8*c* which is mounted to the internal combustion engine by means of a bolt (not shown). As shown in FIG. 7, each small container 8*d* is formed with a notch portion 8*e* which is lower than an outer periphery 8*f* of the casing 8.

Figure 8:
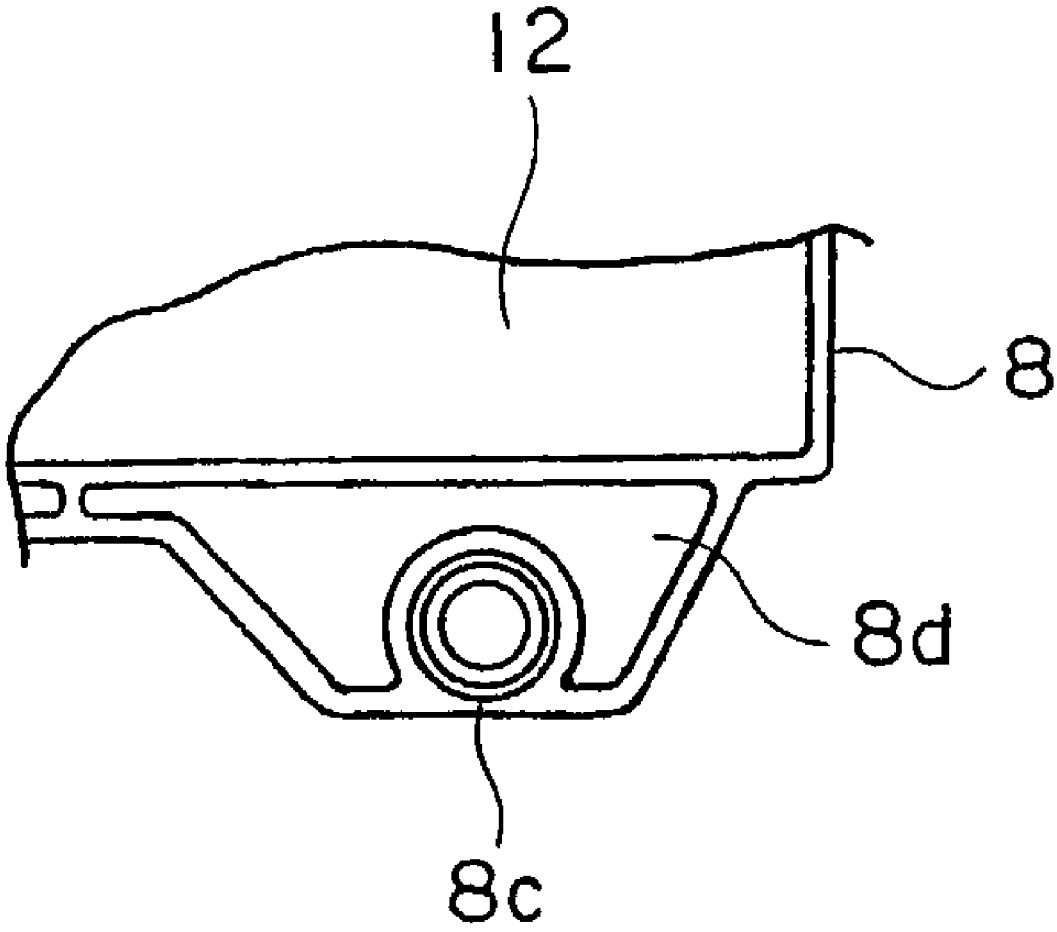
FIG. 8 is a view showing a modification of a small container.

Here, note that each of the small containers 8*d* of the casing 8 may instead be formed between a corresponding mounting portion 8*c* mounted to the internal combustion engine by the bolt (not shown) and the casted resin portion 12, as shown in FIG. 8.

The respective closed magnetic circuit cores 2 of the first through third transformers 1A, 1B and 1C built in the casing 8 are arranged along an axial direction A (see FIG. 4) of the coil parts 100 so that the planes of the respective closed magnetic circuit cores 2 may be disposed flush with one another and in parallel with the bottom surface of the casing 8. In addition, the respective closed magnetic circuit cores 2 are arranged in such a manner that the mutually adjacent non-excitation portions 2*c* overlap each other by a prescribed length 2*e* in the axial direction A of the coil parts 100. Moreover, the coil parts 100 arranged around the excitation portions 2*a* of the mutually adjacent closed magnetic circuit cores 2 are provided on the excitation portions 2*a* which are mutually different sides in a zigzag form along the axial direction A.

Figure 9:
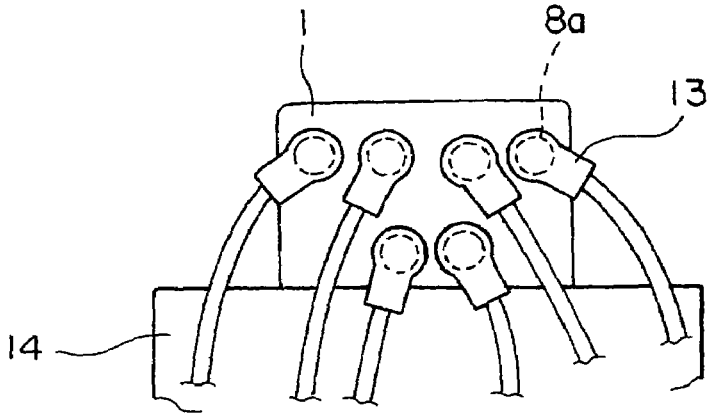
FIG. 9 is a view showing the arrangement of high-tension cords according to the first embodiment of the present invention.
Figure 11:
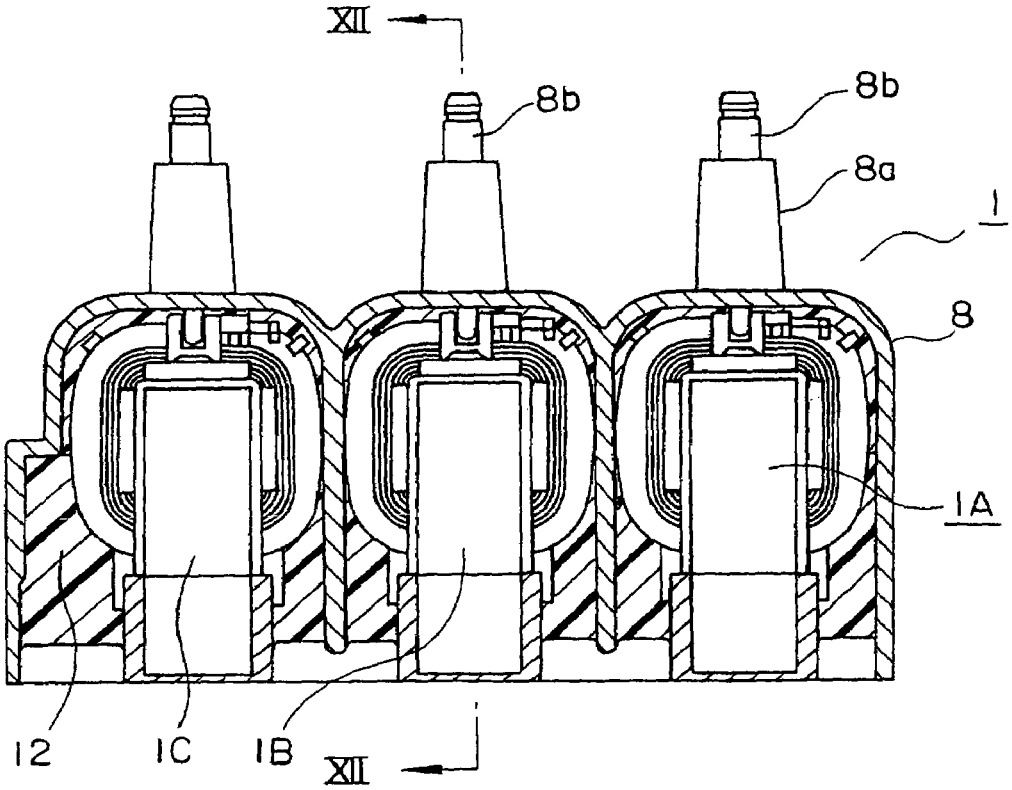
Fig. 11 PRIOR ART
FIG. 11 is a cross sectional view of a known ignition apparatus for an internal combustion engine.

The opposite ends of the conducting wire of each primary coil 4 are electrically connected with terminals 4*a* inserted into a corresponding primary bobbin 3 by soldering or welding. The terminals 4*a* are electrically connected through an appropriate means such as welding or the like with the conductor 10 of the conductor module 9 that is formed by insert molding. The conductor module 9 shown in FIG. 9 is provided with the connector 9*a* having the connector terminals 10*a* adapted to be electrically connected with the external equipment of the ignition apparatus for an internal combustion engine.

The conductor module 9 is arranged on the first through third transformers 1A, 1B and 1C so as not to be superposed on the coil parts 100. The conductor module 9 is formed at a base portion of the connector 9*a* with an engagement portion 9*d* which is adapted to be press-fitted into the casing 8 for engagement therewith. The conductor module 9 is also formed with a crank-shaped concave portion 9*c* in which air is filled to form an air layer 9*b*. The depth of the air layer 9*b* reaches almost up to the height of the secondary coils 6. Note that this air layer 9*b* takes the shape of a continuously connected configuration, but it may be divided into a plurality of separate sections.

As shown in FIG. 4, the conducting wire of each secondary coil 6 is electrically connected at its opposite ends with terminals 6*a* fixedly secured to the fixed part 5*a* of a corresponding secondary bobbin 5 by means of soldering or the like. The terminals 6*a* are each formed at their tip end with a press fitting portion 6*b*, so that when the transformers 1A, 1B and 1C are assembled into the casing 8, the press fitting portions 6*b* of the terminals 6*a* are press-fitted into corresponding secondary terminals or high-voltage terminals 8*b* which have been insert molded or press-fitted into the casing 8 beforehand, thereby providing electrical connection therebetween.

The closed magnetic circuit cores 2 of the first through third transformers 1A, 1B and 1C are arranged in a zigzag fashion along the axial direction A of the coil parts 100. Also, the plurality of coil parts 100 are provided on the excitation portions 2*a* which are mutually different sides in a zigzag form along the axial direction A. In addition, the secondary terminals 8*b* and their surrounding high-voltage towers 8*a* are similarly arranged in a zigzag fashion along the axial direction A. Moreover, these secondary terminals 8*b* and high-voltage towers 8*a* are arranged apart from and at the side of the excitation portions 2*a* of the closed magnetic circuit cores 2. High-tension cords (not shown) are connected at their one end with the high-voltage towers 8*a*, respectively, and at their other end with spark plugs (not shown), respectively, which are installed in the respective engine cylinders.

With the ignition apparatus for an internal combustion engine as constructed above, after the plurality of transformers 1A, 1B, 1C, the conductor module 9, etc., are arranged in the casing 8, a casting resin such as an epoxy resin is poured or casted into the casing 8 under a vacuum atmosphere so as to form the casted resin portion 12. The casting resin thus poured is caused to infiltrate into spaces or gaps between the respective component members of the transformers 1A, 1B and 1C, and then to be set or cured at a high temperature in a curing oven, thereby achieving the fixing of the respective component members and the electrical insulation thereof against high voltages.

As described above, according to the ignition apparatus 120 for an internal combustion engine of the first embodiment, the respective closed magnetic circuit cores 2 are arranged in such a manner that the mutually adjacent non-excitation portions 2*c* overlap each other by the prescribed length 2*e* in the axial direction A of the coil parts 100. As a result, the length of the casing 8 in the axial direction A is shortened, thus making it possible to reduce the size and cost of the entire ignition apparatus.

In addition, the respective closed magnetic circuit cores 2 of the first through third transformers 1A, 1B and 1C built in the casing 8 are arranged along the axial direction A of the coil parts 100 in such a manner that the planes of the respective closed magnetic circuit cores 2 are disposed flush with one another and in parallel with the bottom surface of the casing 8. Accordingly, the overall height of the casing 8 is shortened, as a result of which the entire ignition apparatus is miniaturized and the cost of manufacture thereof is reduced.

In addition, the plurality of closed magnetic circuit cores 2 are arranged along the axial direction A of the coil parts 100, and the plurality of coil parts 100 are also arranged on the excitation portions 2*a* which are mutually different sides in a zigzag form along the axial direction A. With such an arrangement, when the high-tension cords 13 are attached to the ignition apparatus 120 which has been installed on the internal combustion engine 14, there is room in space in the surroundings of the high-voltage towers 8*a*, as shown in FIG. 9, and as a result, the efficiency in the assembling operation of the high-tension cords 13 can be improved.

Further, the secondary terminals 8*b* and the high-voltage towers 8*a* are arranged apart from and at the side of the excitation portions 2*a* of the closed magnetic circuit cores 2, so that ample insulation distances between the secondary terminals 8*b* of the highest potential and the side portions 2*f* of the closed magnetic circuit cores 2 of the lowest potential can be secured in a reliable manner.

Furthermore, the conductor module 9 is arranged over the transformers 1A, 1B and 1C in an area in which it is not superposed on the coil parts 100. Thus, an empty space over the transformers 1A, 1B and 1C can be utilized for the arrangement of the conductor module 9, and hence effective use of the space within the casing 8 can be made so that the entire size and manufacturing cost of the ignition apparatus can be reduced.

In addition, the mounting portions 8*c* for mounting the ignition apparatus to the internal combustion engine 14 are formed at four places of the outer periphery of the casing 8. Accordingly, a change in the design of the mounting portions 8*c* can be dealt with by merely changing the design of the casing 8 including the mounting portions alone in comparison with a conventional ignition apparatus (different from the one described in the "Description of the Related Art" section) in which the mounting portions exist in individual members which are arranged in and formed separately from the casing, and in which it is necessary to change the design or arrangement of the casing as well as the individual members and their related parts arranged in the casing so as to meet a change in the design of the mounting portions. Consequently, the degree of freedom in design is improved.

Moreover, the non-excitation portions 2*c* of the closed magnetic circuit cores 2 are overcoated with the buffer members 7 made of an elastic material such as a resin, rubber, a thermoplastic elastomer, etc, so that stress due to thermal strain caused by a difference in the coefficients of linear expansion of the closed magnetic circuit cores 2 and the casted resin portion 12 under a thermal shock atmosphere can be absorbed by the buffer members 7. As a result, it is possible to prevent the generation of cracks in the casted resin portion 12.

Further, the shore hardness of the buffer members 7 is set in a range from A64 to A87. This serves to prevent the generation of cracks in the casted resin portion 12. Additionally, the buffer members 7 have a moderate hardness capable of smoothly receiving the transformers 1A, 1B and 1C into the casing 8 in automatic assembling on production lines, resulting in improvements in the assembling operation.

Furthermore, the concave portion 9*c* with the air layer 9*b* is provided in the conductor module 9 arranged at the opening of the casing 8, so that stress due to thermal strain caused by a difference in the coefficients of linear expansion of the component members in the casing 8 and the casted resin portion 12 at the opening of the casing 8 under a thermal shock atmosphere can be absorbed by the air layer 9*b* in the concave portion 9*c*, thus making it possible to prevent cracks from being generated in the casted resin portion 12.

Still further, the air layer 9*b* is formed in the neighborhood of the coil parts 100 where thermal strain are most likely to take place. Thus, it is possible to prevent the generation of cracks in the casted resin portion 12 more efficiently.

In addition, the depth of the air layer 9*b* reaches almost up to the height of the secondary coils 6, and hence stress due to the thermal strain of the casted resin portion 12 caused by the secondary coils 6 can be absorbed by the air layer 9*b* in a reliable manner, whereby it is possible to prevent the generation of peeling off of the casted resin portion 12 and the secondary coil 6 from each other.

Here, note that in case of an ignition apparatus for an internal combustion engine unprovided with the conductor module 9, the generation of cracks in the casted resin portion can be prevented by forming a concave portion in such a manner that an air layer is provided in the casted resin portion at the opening of the casing.

Moreover, the casing 8 has small containers or voids 8*d* formed at opposite sides of each mounting portion 8*c* which is fixedly secured to the internal combustion engine by means of an unillustrated bolt. Thus, stress due to thermal strain caused by a difference in the coefficients of linear expansion of the component members in the casing 8 and the casted resin portion 12 at the opening of the casing 8 under a thermal shock atmosphere can also be absorbed by the small containers or voids 8*d*. As a consequence, it is possible to prevent the generation of cracks at an opening of the casting resin 12 in a more reliable manner.

Incidentally, it is to be noted that in case of an ignition apparatus for an internal combustion engine unprovided with the conductor module 9, by forming small containers or voids in the casing alone, it is of course possible to prevent cracks from being generated in the casted resin portion 12 under a thermal shock atmosphere.

Further, the small containers 8*d* are each formed with a notch portion 8*e*, as shown in FIG. 7, which has a height lower than the outer periphery 8*f* of the casing 8, so that even if an excessive amount of casting resin for forming the casted resin portion 12 is poured into the casing 8 from its opening, it flows into the small containers or voids 8*d* before coming into the concave portion 9*c* of the conductor module 9. Accordingly, the casting resin thus poured can be prevented from flowing into the air layer 9*b* in the conductor module 9, as a result of which the effect of the air layer 9*b* absorbing the stress due to thermal strain can be ensured.

Furthermore, when the small containers or voids 8*d* are formed between the casted resin portion 12 and the mounting portions 8*c*, as shown in FIG. 8, it is possible to prevent cracks from being generated by thermal strain in the casted resin portion 12 in the neighborhood of the mounting portions 8*c*.

Embodiment 2.

Figure 10:
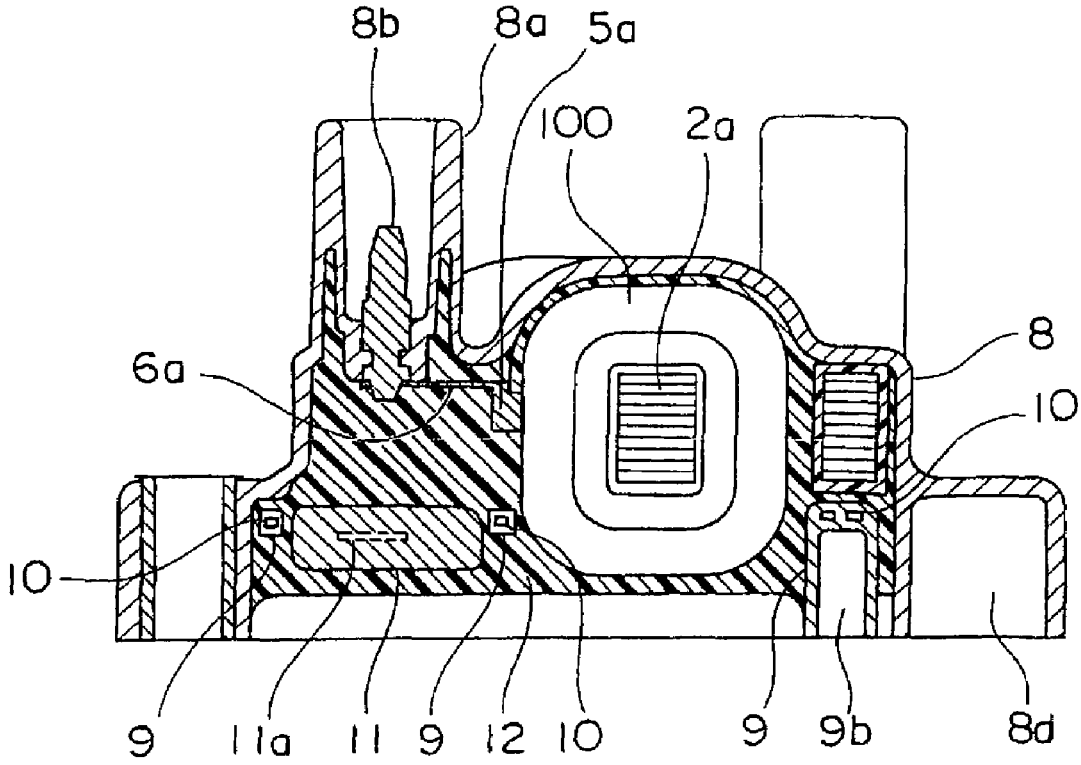
FIG. 10 is a cross sectional view showing an ignition apparatus for an internal combustion engine according to a second embodiment of the present invention.
Figure 12:
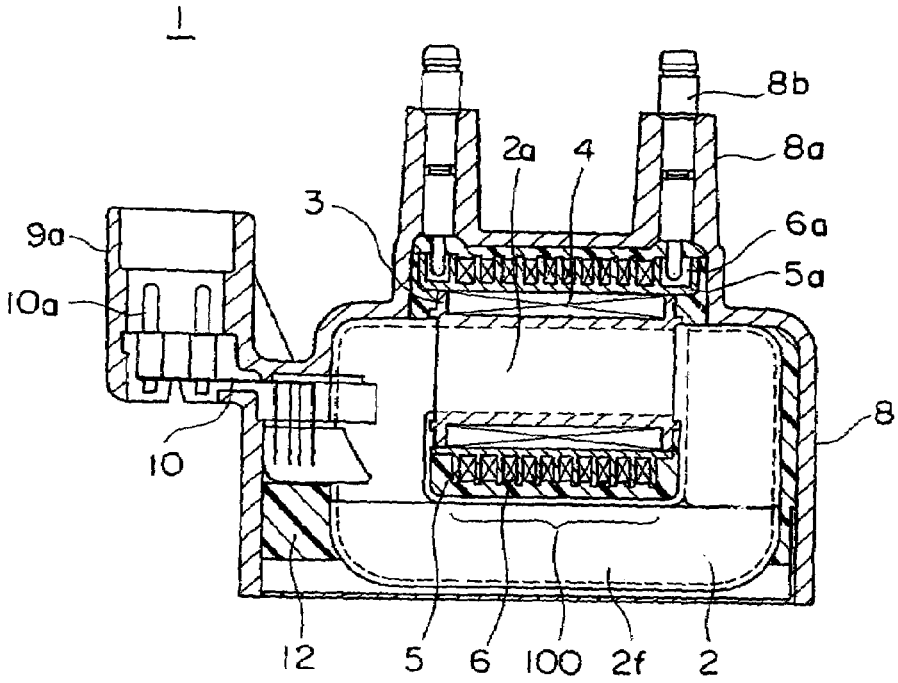
Fig. 12 PRIOR ART
FIG. 12 is a cross sectional arrow view taken along line XII—XII of FIG. 11.
Figure 13:
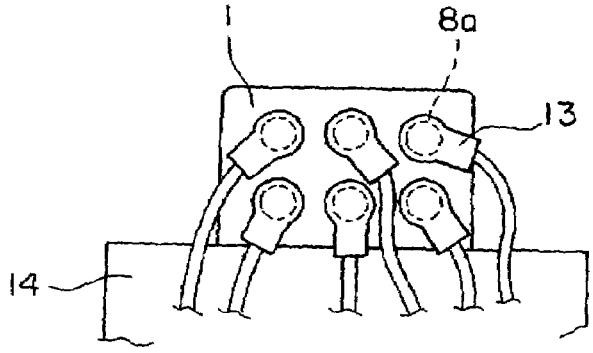
Fig. 13 PRIOR ART
FIG. 13 is a view showing the arrangement of high-tension cords in the known ignition apparatus for an internal combustion engine of FIG. 11.

FIG. 10 is a cross sectional view of essential portions of an ignition apparatus for an internal combustion engine according to a second embodiment of the present invention. In this embodiment, a switching module 11 in the form of an electronic part is built into a casted resin portion 12. The switching module 11 is constructed by molding a substrate 11*a*, on which are mounted switching elements such as power transistors, IGBTs or the like for switching on and off the current supplied to primary coils 4 (see FIG. 1) and integrated circuits (ICs) for controlling the switching elements, into a package with the use of an epoxy resin. In this embodiment, too, three closed magnetic circuit cores 2 are arranged along an axial direction of the coil parts 100 in such a manner that the planes of the three closed magnetic circuit cores 2 are disposed flush with one another and in parallel with the bottom surface of a casing 8, as in the aforementioned first embodiment. The switching module 11 is arranged in parallel with a common surface of the flush planes of the three closed magnetic circuit cores at a location right under secondary terminals 8*b*. The secondary terminals 8*b* are electrically connected with conductors 10 by welding or the like.

In this ignition apparatus for an internal combustion engine, since the switching module 11 is arranged in parallel with the common surface of the planes of the closed magnetic circuit cores in an empty space right under the high-voltage towers 8*a*, there is no need for providing a new or additional space for arrangement of the switching module 11, thus making it possible to avoid increasing the size of the ignition apparatus.

Here, note that the electronic part constituting the switching module 11 may be a sensor module of an ionic current detection unit, etc.

Although the ignition apparatus for an internal combustion engine according to the first or second embodiment is an ignition apparatus for an internal combustion engine in a simultaneously firing ignition system, the present invention is also applicable to an ignition apparatus for an internal combustion engine in an independently firing ignition system. In addition, the present invention can of course be applied to an ignition apparatus for an internal combustion engine with two or more transformers.

As described above, an ignition apparatus for an internal combustion engine according to a first aspect of the present invention comprises: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The plurality of closed magnetic circuit cores are arranged along an axial direction of the coil parts in such a manner that adjacent ones of the non-excitation portions, which are those sides of adjacent cores each of which extends from one end of a corresponding excitation portion, overlap each other at least partially in the axial direction of the coil parts. With this arrangement, the size of the casing in the axial direction of the coil parts is shortened, and hence the entire size and manufacturing cost of the ignition apparatus is reduced.

An ignition apparatus for an internal combustion engine according to a second aspect of the present invention comprises: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The plurality of closed magnetic circuit cores are arranged along an axial direction of the coil parts in such a manner that the planes of the closed magnetic circuit cores are disposed flush with one another and in parallel with a bottom surface of the casing. With this arrangement, by shortening the total height of the casing, the size and the manufacturing cost of the ignition apparatus is reduced.

An ignition apparatus for an internal combustion engine according to a third aspect of the present invention comprises: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The plurality of closed magnetic circuit cores are arranged along an axial direction of the coil parts, and the plurality of coil parts are arranged on those sides of the cores which are at mutually different sides in a zigzag form along the axial direction of the coil parts. With this arrangement, when high-tension codes are attached to the ignition apparatus which has been mounted on the internal combustion engine, there is ample room in space in the surroundings of the high-voltage towers, so that the efficiency in the assembling operation of the high-tension cords can be improved.

An ignition apparatus for an internal combustion engine according to a fourth aspect of the present invention comprises: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a plurality of conductors electrically connecting between the coil parts and external connection terminals. The plurality of closed magnetic circuit cores are arranged along an axial direction of the coil parts in such a manner that the planes of the closed magnetic circuit cores are disposed flush with one another to form one and the same plane and in parallel with a bottom surface of the casing. The plurality of conductors combined with one another are arranged in parallel with the one and the same plane in an area in which the conductors are not superposed on the coil parts. With this arrangement, an empty space over the coil parts can be utilized for the arrangement of the conductors, and hence effective use of the space within the casing can be made. As a result, the size and manufacturing cost of the ignition apparatus can be reduced.

An ignition apparatus for an internal combustion engine according to a fifth aspect of the present invention comprises: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and an electronic part for controlling operations of the coil parts. The plurality of closed magnetic circuit cores are arranged along an axial direction of the coil parts in such a manner that the planes of the closed magnetic circuit cores are disposed flush with one another to form one and the same plane and in parallel with a bottom surface of the casing. The electronic part is arranged in parallel with the one and the same plane in an area in which the electronic part is not superposed on the coil parts. With this arrangement, no new or additional space for the arrangement of the electronic part is necessary, and hence there is no need to increase the size of the ignition apparatus.

An ignition apparatus for an internal combustion engine according to a sixth aspect of the present invention comprises: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; an electronic part for controlling operations of the coil parts; and secondary terminals connected with the secondary coils. The plurality of closed magnetic circuit cores are arranged along an axial direction of the coil parts in such a manner that the planes of the closed magnetic circuit cores are disposed flush with one another to form one and same plane and in parallel with a bottom surface of the casing. The electronic part is arranged in parallel with the one and same plane and on axes of the secondary terminals. With this arrangement, the electronic part can be arranged in a space where high-voltage towers are installed. Consequently, no new or additional space for the arrangement of the electronic part is necessary, and hence there is no need to increase the size of the ignition apparatus.

An ignition apparatus for an internal combustion engine according to a seventh aspect of the present invention comprises: a casing; a plurality of hollow-rectangular-shaped closed magnetic circuit cores being built in the casing and each having an excitation portion and non-excitation portions; and a plurality of coil parts each including a primary coil and a secondary coil which are arranged to surround the excitation portion of a corresponding one of the closed magnetic cores. The casing is provided with mounting portions fixedly secured to the internal combustion engine. With this arrangement, the mounting portions are arranged on separate members which are formed separately from and arranged in the casing. Accordingly, a change in the design of the mounting portions can be dealt with by merely changing the design of the casing including the mounting portions alone in comparison with a conventional ignition apparatus in which the mounting portions exist in individual members which are arranged in and formed separately from the casing, and in which it is necessary to change the design or arrangement of the casing as well as the individual members and their related parts arranged in the casing so as to meet a change in the design of the mounting portions. Consequently, the degree of freedom in design can be improved.

An ignition apparatus for an internal combustion engine according to an eighth aspect of the present invention comprises: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a resin portion filled in the casing to fixedly secure the closed magnetic circuit cores and the coil parts to the casing. Buffer members are provided on the sides of the closed magnetic circuit cores except for the excitation portion so as to surround these sides thereby to buffer thermal stress generated in the resin portion. With this arrangement, stress due to thermal strain caused by a difference in the coefficients of linear expansion of the closed magnetic circuit cores and the resin portion under a thermal shock atmosphere can be absorbed by the buffer members. Consequently, it is possible to prevent the generation of cracks in the resin portion more efficiently.

An ignition apparatus for an internal combustion engine according to a ninth aspect of the present invention comprises: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a resin portion filled in the casing to fixedly secure the closed magnetic circuit cores and the coil parts to the casing. The casing is formed at its opening side with a concave portion having an air layer for absorbing thermal deformations of the resin portion. With this arrangement, stress due to thermal strain caused by a difference in the coefficients of linear expansion of the component members in the casing and the resin portion at an opening of the casing under a thermal shock atmosphere can be absorbed by the air layer in the concave portion. Accordingly, it is possible to prevent the generation of cracks in the resin portion more efficiently.

An ignition apparatus for an internal combustion engine according to a tenth aspect of the present invention comprises: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; a resin portion filled in the casing to fixedly secure the closed magnetic circuit cores and the coil parts to the casing; and a conductor module having a plurality of insert-molded conductors for electrically connecting between the coil parts and external connection terminals. The conductor module is formed with a concave portion having an air layer for absorbing thermal deformations of the resin portion. With this arrangement, stress due to thermal strain caused by a difference in the coefficients of linear expansion of the component members in the casing and the resin portion at an opening of the casing under a thermal shock atmosphere can be absorbed by the air layer in the concave portion. This serves to prevent the generation of cracks in the resin portion. In addition, the conductor module that bundles the plurality of conductors also has the function of air layers and contributes to reduction in the cost of manufacture.

An ignition apparatus for an internal combustion engine according to an eleventh aspect of the present invention comprises: a casing; a plurality of hollow-rectangular-shaped closed magnetic circuit cores being built in the casing and each having an excitation portion and non-excitation portions; a plurality of coil parts each including a primary coil and a secondary coil which are arranged to surround the excitation portion of a corresponding one of the closed magnetic cores; and a resin portion filled in the casing to fixedly secure the closed magnetic circuit cores and the coil parts to the casing. The casing is provided on its outer periphery with a small container having an air layer for absorbing thermal deformations of the resin portion. With this arrangement, stress due to thermal strain caused by a difference in the coefficients of linear expansion of the component members in the casing and the resin portion at an opening of the casing under a thermal shock atmosphere can also be absorbed by the small container. This serves to prevent the generation of cracks in the resin portion.

Preferably, the plurality of closed magnetic circuit cores are arranged along an axial direction of the coil parts in such a manner that the planes of the closed magnetic circuit cores are disposed flush with one another and in parallel with a bottom surface of the casing. Accordingly, by shortening the total height of the casing, the size and the manufacturing cost of the ignition apparatus can be reduced.

Preferably, the plurality of closed magnetic circuit cores are arranged along an axial direction of the coil part, and the plurality of coil parts are arranged on those sides of the cores which are at mutually different sides in a zigzag form along the axial direction of the coil parts. Accordingly, when high-tension codes are attached to the ignition apparatus which has been mounted on the internal combustion engine, there is ample room in space in the surroundings of the high-voltage towers, and hence the efficiency in the assembling operation of the high-tension cords can be improved.

Preferably, the plurality of closed magnetic circuit cores are arranged along an axial direction of the coil parts in such a manner that the planes of the closed magnetic circuit cores are disposed flush with one another and in parallel with a bottom surface of the casing, and the plurality of conductors combined with one another are arranged in parallel with the one and the same plane in an area in which the conductors are not superposed on the coil parts. Thus, an empty space over the coil parts can be utilized for the arrangement of the conductors, and hence effective use of the space within the casing can be made. As a result, the size and manufacturing cost of the ignition apparatus can be reduced.

Preferably, the plurality of closed magnetic circuit cores are arranged along an axial direction of the coil parts in such a manner that the planes of the closed magnetic circuit cores are disposed flush with one another and in parallel with a bottom surface of the casing, and the electronic part for controlling the operation of the coil parts is arranged in parallel with the one and the same plane in an area in which the electronic part is not superposed on the coil parts. Accordingly, no new or additional space for the arrangement of the electronic part is necessary, and hence there is no need to increase the size of the ignition apparatus.

Preferably, the plurality of closed magnetic circuit cores are arranged along an axial direction of the coil parts in such a manner that the planes of the closed magnetic circuit cores are disposed flush with one another and in parallel with a bottom surface of the casing, and the electronic part for controlling the operation of the coil parts is arranged in parallel with the one and the same plane and on axes of secondary terminals connected with the secondary coils. Thus, the electronic part can be arranged in a space where high-voltage towers are installed. Consequently, no new or additional space for the arrangement of the electronic part is necessary, and hence there is no need to increase the size of the ignition apparatus.

Preferably, the casing is provided with mounting portions fixedly secured to the internal combustion engine. Thus, the mounting portions are arranged on separate members which are formed separately from and arranged in the casing. Accordingly, a change in the design of the mounting portions can be dealt with by merely changing the design of the casing including the mounting portions alone in comparison with a conventional ignition apparatus in which the mounting portions exist in individual members which are arranged in and formed separately from the casing, and in which it is necessary to change the design or arrangement of the casing as well as the individual members and their related parts arranged in the casing so as to meet a change in the design of the mounting portions. Consequently, the degree of freedom in design can be improved.

Preferably, buffer members are provided on the sides of the closed magnetic circuit cores except for the excitation portion so as to surround these sides thereby to buffer thermal stress generated in the resin portion. Thus, stress due to thermal strain caused by a difference in the coefficients of linear expansion of the closed magnetic circuit cores and the resin portion under a thermal shock atmosphere can be absorbed by the buffer members. Consequently, it is possible to prevent the generation of cracks in the resin portion more efficiently.

Preferably, the casing is formed at its opening side with a concave portion having an air layer for absorbing thermal deformations of the resin portion. Thus, stress due to thermal strain caused by a difference in the coefficients of linear expansion of the component members in the casing and the resin portion at an opening of the casing under a thermal shock atmosphere can be absorbed by the air layer in the concave portion. Accordingly, it is possible to prevent the generation of cracks in the resin portion more efficiently.

Preferably, the conductor module is formed with a concave portion having an air layer for absorbing thermal deformations of the resin portion. Thus, stress due to thermal strain caused by a difference in the coefficients of linear expansion of the component members in the casing and the resin portion at an opening of the casing under a thermal shock atmosphere can be absorbed by the air layer in the concave portion. This serves to prevent the generation of cracks in the resin portion. In addition, the conductor module that bundles the plurality of conductors also has the function of air layers and contributes to reduction in the cost of manufacture.

Preferably, the casing is provided on its outer periphery with a small container having an air layer for absorbing thermal deformations of a resin portion which fixedly secures the closed magnetic circuit cores and the coil parts to an inner side of the casing. Thus, stress due to thermal strain caused by a difference in the coefficients of linear expansion of the component members in the casing and the resin portion at an opening of the casing under a thermal shock atmosphere can also be absorbed by the small container. This serves to prevent the generation of cracks in the resin portion.

Preferably, the buffer members have a shore hardness in the range of A64–A87.22, so that it is possible to prevent cracks from being generated in the resin portion. Additionally, the buffer members have a moderate hardness capable of smoothly receiving the closed magnetic circuit cores into the casing in automatic assembling on production lines, thus resulting in improvements in the assembling operation.

Preferably, the air layer in the concave portion is arranged between the adjacent closed magnetic circuit cores so that it is possible to prevent cracks from being generated in the resin portion.

Preferably, the air layer in the concave portion has a depth which almost reaches the secondary coils, so that it is possible to prevent peeling off between the resin portion and the secondary coils, which would otherwise be liable to be caused especially by thermal strain.

Preferably, the casing is formed on its outer periphery with a notch portion which is connected with the small container. Thus, even if an excessive amount of casting resin for forming the resin portion is poured into the casing from its opening, it flows into the small containers before coming into the concave portion of the conductor module. Accordingly, the casting resin thus poured can be prevented from flowing into the air layer in the conductor module. As a result, the effect of stress absorption due to thermal strain in the air layer can be secured.

Preferably, an air layer is formed between the mounting portions and the resin portion. Thus, stress due to thermal strain caused by a difference in the coefficients of linear expansion of the component members in the casing and the resin portion at an opening of the casing under a thermal shock atmosphere can be absorbed by the air layer in the concave portion, whereby the generation of cracks in the resin portion can be prevented. In addition, the mounting portions also has the function of air layers and hence contributes to reduction in the cost of manufacture.

Preferably, secondary terminals connected with ends of the secondary coils and high-voltage towers receiving therein the secondary terminals are arranged apart from the closed magnetic circuit cores at the side of the excitation portions. Thus, the distances between the secondary terminals of the highest potential and the sides of the closed magnetic circuit cores of the lowest potential are sufficiently apart from each other, so that dielectric breakdown between the secondary terminals and the closed magnetic circuit cores due to leakage of high voltages can be prevented without especially providing any space to secure insulation distances therebetween. As a result, the total height of the ignition apparatus including the high-voltage towers can be suppressed to a low height.

Preferably, the electronic part comprises a switching module for switching on and off a current supplied to the primary coils. Accordingly, no separate switching module is required, and hence the cost of the entire system can be reduced and the space in the apparatus can be effectively used, thus making it possible to reduce the size of the apparatus.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising: a casing; a plurality of hollow-rectangular-shaped closed magnetic circuit cores being built in said casing and each having an excitation portion and non-excitation portions; and a plurality of coil parts each including a primary coil and a secondary coil which are arranged to surround the excitation portion of a corresponding one of said closed magnetic cores; wherein said plurality of closed magnetic circuit cores are arranged along an axial direction of said coil parts in such a manner that adjacent ones of said non-excitation portions, which are those sides of adjacent cores each of which extends from one end of a corresponding excitation portion, overlap each other at least partially by a predetermined length in the axial direction of said coil parts.

2. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; and a resin portion filled in said casing to fixedly secure said closed magnetic circuit cores and said coil parts to said casing; wherein said plurality of closed magnetic circuit cores are arranged along an axial direction of said coil parts in such a manner that said closed magnetic circuit cores are disposed with one another flush with a plane parallel with a bottom surface of said casing.

3. An ignition apparatus for an internal combustion engine comprising: a casing; a plurality of hollow-rectangular-shaped closed magnetic circuit cores being built in said casing and each having an excitation portion and non-excitation portions; and a plurality of coil parts each including a primary coil and a secondary coil which are arranged to surround the excitation portion of a corresponding one of said closed magnetic cores; wherein said plurality of closed magnetic circuit cores are arranged along an axial direction of said coil parts, and said plurality of coil parts are arranged on those sides of said cores which are at mutually different sides in a zigzag form along the axial direction of said coil parts.

4. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; and a plurality of conductors electrically connecting between said coil parts and external connection terminals; wherein said plurality of closed magnetic circuit cores are arranged along an axial direction of said coil parts in such a manner that the planes of said closed magnetic circuit cores are disposed flush with one another to form one and the same plane and in parallel with a bottom surface of said casing; and said plurality of conductors combined with one another are arranged in parallel with said one and the same plane in an area in which said conductors are not superposed on said coil parts.

5. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; and an electronic part for controlling operations of said coil parts; wherein said plurality of closed magnetic circuit cores are arranged along an axial direction of said coil parts in such a manner that the planes of said closed magnetic circuit cores are disposed flush with one another to form one and the same plane and in parallel with a bottom surface of said casing; and said electronic part is arranged in parallel with said one and the same plane in an area in which said electronic part is not superposed on said coil parts.

6. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; an electronic part for controlling operations of said coil parts; and secondary terminals connected with said secondary coils; wherein said plurality of closed magnetic circuit cores are arranged along an axial direction of said coil parts in such a manner that the planes of said closed magnetic circuit cores are disposed flush with one another to form one and same plane and in parallel with a bottom surface of said casing; and said electronic part is arranged in parallel with said one and same plane and on axes of said secondary terminals.

7. An ignition apparatus for an internal combustion engine comprising: a casing; a plurality of hollow-rectangular-shaped closed magnetic circuit cores being built in said casing and each having an excitation portion and non-excitation portions; and a plurality of coil parts each including a primary coil and a secondary coil which are arranged to surround the excitation portion of a corresponding one of said closed magnetic cores; wherein said casing is provided with mounting portions fixedly secured to said internal combustion engine, and voids at least partially surrounding said mounting portions.

8. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; and a resin portion filled in said casing to fixedly secure said closed magnetic circuit cores and said coil parts to said casing; wherein buffer members are provided on the sides of said closed magnetic circuit cores except for said excitation portion so as to surround these sides thereby to buffer thermal stress generated in said resin portion.

9. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; and a resin portion filled in said casing to fixedly secure said closed magnetic circuit cores and said coil parts to said casing; wherein said casing is formed at its opening side with a concave portion having an air layer for absorbing thermal deformations of said resin portion.

10. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; a resin portion filled in said casing to fixedly secure said closed magnetic circuit cores and said coil parts to said casing; and a conductor module having a plurality of insert-molded conductors for electrically connecting between said coil parts and external connection terminals; wherein said conductor module is formed with a concave portion having an air layer for absorbing thermal deformations of said resin portion.

11. An ignition apparatus for an internal combustion engine comprising: a casing; a plurality of hollow-rectangular-shaped closed magnetic circuit cores being built in said casing and each having an excitation portion and non-excitation portions; a plurality of coil parts each including a primary coil and a secondary coil which are arranged to surround the excitation portion of a corresponding one of said closed magnetic cores; and a resin portion filled in said casing to fixedly secure said closed magnetic circuit cores and said coil parts to said casing; wherein said casing is provided on its outer periphery with a small container having an air layer for absorbing thermal deformations of said resin portion.

12. The ignition apparatus for an internal combustion engine according to claim 1, wherein said plurality of closed magnetic circuit cores are arranged along an axial direction of said coil parts in such a manner that the planes of said closed magnetic circuit cores are disposed flush with one another and in parallel with a bottom surface of said casing.

13. The ignition apparatus for an internal combustion engine according to claim 1, wherein said plurality of closed magnetic circuit cores are arranged along an axial direction of said coil part, and said plurality of coil parts are arranged on those sides of said cores which are at mutually different sides in a zigzag form along the axial direction of said coil parts.

14. The ignition apparatus for an internal combustion engine according to claim 1, further comprising a plurality of conductors electrically connected between said coil parts and external connection terminals, wherein said plurality of closed magnetic circuit cores are arranged along an axial direction of said coil parts in such a manner that the planes of said closed magnetic circuit cores are disposed flush with one another and in parallel with a bottom surface of said casing, and said plurality of conductors combined with one another are arranged in parallel with said one and the same plane in an area in which said conductors are not superposed on said coil parts.

15. The ignition apparatus for an internal combustion engine according to claim 1, further comprising an electronic part for controlling operation of said coil parts, wherein said plurality of closed magnetic circuit cores are arranged along an axial direction of said coil parts in such a manner that the planes of said closed magnetic circuit cores are disposed flush with one another and in parallel with a bottom surface of said casing, and said electronic part for controlling the operation of said coil parts is arranged in parallel with said one and the same plane in an area in which said electronic part is not superposed on said coil parts.

16. The ignition apparatus for an internal combustion engine according to claim 1, further comprising an electronic part for controlling operation of said coil parts, wherein said plurality of closed magnetic circuit cores are arranged along an axial direction of said coil parts in such a manner that the planes of said closed magnetic circuit cores are disposed flush with one another and in parallel with a bottom surface of said casing, and said electronic part for controlling the operation of said coil parts is arranged in parallel with said one and the same plane and on axes of secondary terminals connected with said secondary coils.

17. The ignition apparatus for an internal combustion engine according to claim 1, wherein said casing is provided with mounting portions fixedly secured to said internal combustion engine.

18. The ignition apparatus for an internal combustion engine according to claim 1, further comprising a resin portion filled in said casing to fixedly secure said closed magnetic circuit cores and said coil parts to said casing, wherein buffer members are provided on the sides of said closed magnetic circuit cores except for said excitation portion so as to surround these sides thereby to buffer thermal stress generated in said resin portion.

19. The ignition apparatus for an internal combustion engine according to claim 1, further comprising a resin portion filled in said casing to fixedly secure said closed magnetic circuit cores and said coil parts to said casing, wherein said casing is formed at its opening side with a concave portion having an air layer for absorbing thermal deformations of said resin portion.

20. The ignition apparatus for an internal combustion engine according to claim 1, further comprising a resin portion filled in said casing to fixedly secure said closed magnetic circuit cores and said coil parts to said casing, and a conductor module having a plurality of insert-molded conductors for electrically connecting between said coil parts and external connection terminals, wherein said conductor module is formed with a concave portion having an air layer for absorbing thermal deformations of said resin portion.

21. The ignition apparatus for an internal combustion engine according to claim 1, wherein said casing is provided on its outer periphery with a small container having an air layer for absorbing thermal deformations of a resin portion which fixedly secures said closed magnetic circuit cores and said coil parts to an inner side of said casing.

22. The ignition apparatus for an internal combustion engine according to claim 8, wherein said buffer members have a shore hardness in the range of A64–A87.

23. The ignition apparatus for an internal combustion engine according to claim 9, wherein said air layer in said concave portion is arranged between said adjacent closed magnetic circuit cores.

24. The ignition apparatus for an internal combustion engine according to claim 9, wherein said air layer in said concave portion has a depth which almost reaches said secondary coils.

25. The ignition apparatus for an internal combustion engine according to claim 11, wherein said casing is formed on its outer periphery with a notch portion which is connected with said small container.

26. The ignition apparatus for an internal combustion engine according to claim 17, further comprising a resin portion filled in said casing to fixedly secure said closed magnetic circuit cores and said coil parts to said casing, wherein an air layer is formed between said mounting portions and said resin portion.

27. The ignition apparatus for an internal combustion engine according to claim 1, wherein secondary terminals connected with ends of said secondary coils and high-voltage towers receiving therein said secondary terminals are arranged apart from said closed magnetic circuit cores at the side of said excitation portions.

28. The ignition apparatus for an internal combustion engine according to claim 5, wherein said electronic part comprises a switching module for switching on and off a current supplied to said primary coils.

29. The ignition apparatus for an internal combustion engine as claimed in claim 7, wherein said voids in said casing are located on either side of said mounting portion.

30. The ignition apparatus for an internal combustion engine as claimed in claim 7, wherein said voids in said casing are located between said mounting portion and an adjacent one of said cores.

* * * * *